US009815579B2

(12) United States Patent
Larsson et al.

(10) Patent No.: US 9,815,579 B2
(45) Date of Patent: Nov. 14, 2017

(54) APPARATUS AND METHOD FOR APPLICATION OF LIDS TO CONTAINERS

(75) Inventors: Lennart Larsson, Malmö (SE); Per Hagelqvist, Lund (SE); Per Rasmusson, Helsingborg (SE)

(73) Assignee: A&R CARTON LUND AB, Lund (SE)

( * ) Notice: Subject to any disclaimer, the term of this patent is extended or adjusted under 35 U.S.C. 154(b) by 726 days.

(21) Appl. No.: 14/373,282

(22) PCT Filed: Jan. 20, 2012

(86) PCT No.: PCT/SE2012/050044

§ 371 (c)(1),
(2), (4) Date: Dec. 2, 2014

(87) PCT Pub. No.: WO2013/109174

PCT Pub. Date: Jul. 25, 2013

(65) Prior Publication Data

US 2015/0121815 A1 May 7, 2015

(51) Int. Cl.
*B65B 35/18* (2006.01)
*B65B 61/20* (2006.01)
(Continued)

(52) U.S. Cl.
CPC ..... *B65B 35/18* (2013.01); *B65B 7/2807* (2013.01); *B65B 7/2871* (2013.01); *B65B 35/16* (2013.01);
(Continued)

(58) Field of Classification Search
CPC ..... B65B 35/18; B65B 7/2807; B65B 7/2871; B65B 35/16; B65B 61/20; B65B 61/202; B65D 51/246; B65D 43/169
(Continued)

(56) References Cited

U.S. PATENT DOCUMENTS 1,614,042 A * 1/1927 Pennock ..... B67B 3/2053 53/306
1,855,675 A * 4/1932 Hoffmeister ..... B65B 25/04 141/249
(Continued)

FOREIGN PATENT DOCUMENTS

EP 0358617 A1 * 3/1990 ..... B31B 1/00
EP 0358617 A1 3/1990
(Continued)

OTHER PUBLICATIONS

Extended European Search Report for EP 12865796, completed Jun. 11, 2015.
(Continued)

*Primary Examiner* — Hemant M Desai
*Assistant Examiner* — Lucas Palmer
(74) *Attorney, Agent, or Firm* — Brinks Gilson & Lione

(57) ABSTRACT

The invention concerns an apparatus for automatic application of lids to containers, said apparatus comprising a rotatable device unit comprising a plurality of circumferentially distributed lid holding members, a lid feeding unit, a glue application unit and a lid application unit. The lid holding members can be directed to each of the units simultaneously by rotating the rotatable device unit. The rotatable device unit further comprises an item application unit configured to fit an individual additional item onto the lid before the lid is attached to the container. The item application unit comprises an item supply unit and at least one movable gripping device configured to grip an individual additional item from the item supply unit and fit the individual additional item onto the lid. The invention also concerns a method for automatic application of lids to containers.

20 Claims, 11 Drawing Sheets

(51) Int. Cl.

| | |
|---|---|
| ***B65B 7/28*** | (2006.01) |
| ***B65D 51/24*** | (2006.01) |
| ***B65B 35/16*** | (2006.01) |
| *B65D 43/16* | (2006.01) |

(52) U.S. Cl.
CPC ..... *B65B 61/20* (2013.01); *B65B 61/202* (2013.01); *B65D 51/246* (2013.01); *B65D 43/169* (2013.01)

(58) Field of Classification Search
USPC ..... 53/420, 473, 287, 300, 301, 307, 309, 53/312, 236; 221/165, 210, 220, 163, 221/164, 166; 198/468.6, 468.8, 468.9
See application file for complete search history.

(56) References Cited

U.S. PATENT DOCUMENTS 1,881,845 A * 10/1932 Morris ..... B65B 61/20 271/99
1,986,505 A * 1/1935 Fischer ..... B67B 3/14 53/137.1
1,989,039 A * 1/1935 Geyer ..... B65B 7/2807 198/345.1
2,059,546 A * 11/1936 Brandenburg ..... B65B 43/44 221/220
2,082,048 A * 6/1937 Everett ..... B67B 3/2033 221/298
2,175,255 A * 10/1939 Chapman ..... B65B 43/52 198/467.1
2,246,243 A * 6/1941 Clark ..... B65B 11/46 53/221
2,322,175 A * 6/1943 Talbot ..... B65B 61/20 271/139
2,539,467 A * 1/1951 Pechy ..... B65B 7/2807 414/797.7
2,563,728 A * 8/1951 Kulpinski ..... B65B 61/20 221/209
2,717,730 A * 9/1955 Blann ..... B65B 7/28 221/210
2,729,379 A * 1/1956 Wilcox ..... B67B 3/02 198/614
2,852,899 A * 9/1958 Murrell ..... B67B 5/03 156/DIG. 14
2,877,926 A * 3/1959 Abbe ..... B65B 35/02 221/222
2,984,378 A * 5/1961 Gunter ..... B65C 3/20 156/489
3,030,262 A * 4/1962 Gunter ..... B65C 9/08 156/489
3,049,166 A * 8/1962 Clark ..... B65C 3/20 156/489
3,077,287 A * 2/1963 White ..... B67B 5/03 221/11
3,144,148 A * 8/1964 Merkner ..... B65B 21/12 294/98.1
3,178,217 A * 4/1965 Bargel ..... B65B 21/12 294/119.3
3,212,175 A * 10/1965 Wonneman ..... B65B 7/28 29/776
3,282,025 A * 11/1966 Amberg ..... B65B 7/2807 53/282
3,293,823 A * 12/1966 Anderson ..... B65B 7/2807 53/131.4
3,340,591 A * 9/1967 Fisher ..... B65C 3/18 156/DIG. 14
3,355,858 A * 12/1967 Jahn ..... B65B 7/2807 53/303
3,360,844 A * 1/1968 Wonneman ..... B65B 7/28 221/290
3,374,605 A * 3/1968 Satchwell ..... B67B 3/06 221/278
3,392,505 A * 7/1968 Luther ..... B67B 3/2053 53/307
3,407,563 A * 10/1968 Dieter ..... B65B 17/025 53/138.1
3,415,034 A * 12/1968 Schmitt ..... B65D 69/00 206/515
3,422,597 A * 1/1969 Beer ..... B65G 47/08 221/221
3,431,695 A * 3/1969 Earling ..... A23G 9/265 227/131
3,458,970 A * 8/1969 Draper ..... A21C 9/08 198/437
3,549,459 A * 12/1970 Whitecar ..... B65B 61/202 156/383
3,600,254 A * 8/1971 Clark ..... B65C 3/24 156/489
3,626,657 A * 12/1971 Heisler ..... B65B 27/10 100/14
3,628,307 A * 12/1971 Croasdale ..... B65B 7/2807 53/299
3,629,989 A * 12/1971 Reinecke ..... B65B 7/2807 53/306
3,712,023 A * 1/1973 Bryan, Jr. ..... B65B 7/2807 53/282
3,720,343 A * 3/1973 Irish, Jr. ..... B65D 39/02 215/246
3,939,625 A * 2/1976 Remele ..... B41F 17/24 53/131.3
3,976,029 A * 8/1976 Rosner ..... B05C 1/08 118/215
3,987,605 A * 10/1976 Johnson ..... B65B 11/34 53/234
4,047,473 A * 9/1977 Fletcher ..... B21D 51/46 493/108
4,065,909 A * 1/1978 Mueller ..... B65B 7/168 53/129.1
4,091,915 A * 5/1978 Claasen ..... B65B 35/36 198/389
4,215,460 A * 8/1980 Amberg ..... B29C 63/423 156/86
4,238,267 A * 12/1980 Konstantin ..... B29C 61/025 156/215
4,307,557 A * 12/1981 Shimizu ..... B65B 7/2807 53/131.3
4,409,045 A * 10/1983 Busse ..... B29C 65/02 156/446
4,444,610 A * 4/1984 Torterotot ..... B65B 61/18 156/264
4,478,024 A * 10/1984 Vedvik ..... B65B 35/16 53/247
4,498,275 A * 2/1985 Baron ..... B65B 3/36 53/282
4,519,186 A * 5/1985 Winter ..... B29C 63/423 156/567
4,525,154 A * 6/1985 Sauget ..... B31C 7/04 493/154
4,548,668 A * 10/1985 Roth ..... B31B 1/00 118/317
4,562,684 A * 1/1986 Dreher ..... B29C 63/423 29/775
4,597,704 A * 7/1986 Vedvik ..... B65B 35/16 198/434
4,691,500 A * 9/1987 Danforth ..... B65B 7/2878 156/69
4,696,143 A * 9/1987 Young ..... B67B 3/22 53/289
4,750,312 A * 6/1988 de Vaujany ..... B65B 7/2807 53/307
4,814,134 A * 3/1989 Brown ..... B29C 45/42 264/297.8
4,817,363 A * 4/1989 St. Clair ..... B29C 65/568 53/300
4,827,692 A * 5/1989 Fiske ..... B65B 5/06 53/244
4,848,060 A * 7/1989 Kubis ..... B65B 7/2807 53/307

(56) References Cited

U.S. PATENT DOCUMENTS 4,866,907 A * 9/1989 Iuchi ..... B65B 7/28 53/299
4,903,458 A * 2/1990 Hakansson ..... B65D 77/28 156/443
4,938,338 A * 7/1990 Crawford ..... B65G 47/841 198/408
4,977,727 A * 12/1990 Milleson ..... B65B 35/36 53/247
4,987,721 A * 1/1991 Turtschan ..... B65B 55/10 198/665
5,067,304 A * 11/1991 Kuethe ..... B65B 61/202 53/133.1
5,095,681 A * 3/1992 Choi ..... B67B 3/22 198/394
5,101,613 A * 4/1992 Wilhelm ..... B67B 5/036 53/292
5,154,315 A * 10/1992 Dominico ..... B65B 7/2807 221/105
5,236,022 A * 8/1993 Husted ..... A47G 19/34 141/108
5,237,801 A * 8/1993 Hillam ..... B65B 35/44 53/142
5,297,375 A * 3/1994 Reil ..... B65B 7/2871 156/69
5,429,699 A * 7/1995 Abrams ..... B31B 19/00 156/252
5,438,814 A * 8/1995 Lovett ..... B65B 7/2842 53/282
5,492,592 A * 2/1996 Bergholtz ..... B65B 61/186 156/308.2
5,816,030 A * 10/1998 Carlberg ..... B65B 19/34 53/236
5,934,049 A * 8/1999 Cerf ..... B65B 9/02 53/553
5,946,886 A * 9/1999 Bealer ..... B65B 7/2807 53/287
6,161,367 A * 12/2000 Walter ..... B65B 7/2807 53/133.3
6,341,472 B1 * 1/2002 Schroeder ..... B67B 3/003 53/306
6,371,717 B1 * 4/2002 Grams ..... B25J 15/0052 294/81.61
6,668,517 B2 * 12/2003 Hiramoto ..... B31B 19/00 198/470.1
6,701,692 B1 * 3/2004 Niehr ..... B65B 7/2807 53/167
6,708,748 B1 * 3/2004 Kronseder ..... B65D 51/185 156/570
6,718,732 B1 * 4/2004 Kovara ..... B65B 7/2842 53/264
6,745,541 B2 * 6/2004 Sakurazawa ..... B65B 7/2807 53/287
6,835,042 B2 * 12/2004 de Koning ..... B25J 9/0093 225/101
7,156,248 B2 * 1/2007 Christophe ..... B65D 41/62 215/232
7,412,813 B2 * 8/2008 Heil ..... B65B 7/2807 53/296
7,513,089 B2 * 4/2009 Rubin ..... B65B 11/00 221/123
7,552,570 B2 * 6/2009 Raudat ..... B65B 21/06 53/235
7,677,012 B2 * 3/2010 Cavilli ..... B65B 61/186 53/133.2
7,730,699 B2 * 6/2010 Asma ..... B65B 11/34 53/234
7,762,043 B2 * 7/2010 Skarin ..... B65B 61/186 493/117
8,020,690 B2 * 9/2011 Asma ..... A23G 3/125 198/470.1
8,397,476 B2 * 3/2013 Van Rens ..... B29C 65/18 53/329.2
8,413,799 B2 * 4/2013 Bodtlander ..... B65G 29/00 198/470.1
2001/0032438 A1 * 10/2001 Bonotto ..... B65B 7/2807 53/307
2002/0124534 A1 * 9/2002 Heisey ..... B65B 11/105 53/466
2005/0011730 A1 * 1/2005 Wittmann ..... B65G 47/847 198/470.1
2005/0034424 A1 * 2/2005 Di Stasio ..... B65B 21/18 53/247
2008/0041861 A1 * 2/2008 Crawford ..... B65D 21/022 220/697
2009/0108025 A1 * 4/2009 deVirag ..... G01F 11/086 222/205
2009/0183798 A1 * 7/2009 Till ..... B65G 47/847 141/148
2009/0277132 A1 * 11/2009 Nakajima ..... B65B 1/32 53/167
2015/0121815 A1 * 5/2015 Larsson ..... B65D 51/246 53/471
2015/0158610 A1 * 6/2015 Larsson ..... B65B 35/16 53/473

FOREIGN PATENT DOCUMENTS

FR 2593489 A1 7/1987
JP H02105883 A 4/1990
JP 2898962 B1 * 6/1999
JP 11314618 A 11/1999
JP 2011131929 A * 7/2011
WO 0026091 A1 5/2000
WO 0238448 A1 5/2002
WO WO 0238448 A1 * 5/2002 ..... B65B 61/202

OTHER PUBLICATIONS

International Search Report and Written Opinion for PCT:SE2012:050044, dated Oct. 15, 2012.

* cited by examiner

APPARATUS AND METHOD FOR APPLICATION OF LIDS TO CONTAINERS

RELATED APPLICATIONS

This application claims the benefit under 35 U.S.C. §371 of International Patent Application No. PCT/SE2012/050044, having an international filing date of Jan. 20, 2012, the content of which is incorporated herein by reference in its entirety.

TECHNICAL FIELD

This invention relates to an apparatus and method for providing an individual additional item in a container and applying a lid to an open end of the container. In particular, the invention relates to an automatic apparatus and method where an individual additional item is attached to the lid before the lid is attached to the container.

BACKGROUND OF THE INVENTION

Today, there exist various solutions of automatically providing individual additional items to containers and then applying lids to these containers.

In a known solution of automatically providing individual additional items to containers and then applying lids to these containers, the individual additional item is first placed within a container by dropping it into the container at a first manufacturing process step and thereafter the lid is applied to the container at a second manufacturing step, wherein each container is supplied to and from the first and second manufacturing step by means of a conveyor, e.g. a conveyor belt or conveyor chain. An important issue in this context is the production rate, i.e. the number of containers per a time period that can be supplied with both the individual additional item and the lid. To be commercially successful, the apparatus used for applying the individual additional item and the lid must allow for a high production rate. A problem when trying to increase the production rate when using this known solution is that due to the relatively high supply speed of the containers, the individual additional item may miss the opening of the container when it is dropped, which may cause the additional item to rest across the edges of the container or to end up outside of the container before the lid is applied the container. This in turn will result in no individual additional item within the sealed container or a damaged individual additional item and possibly a damaged lid and/or a damaged container.

In another known method for applying an additional item, e.g. a spoon, to a container, the spoon is glued to the lid of the container before the lid is attached to the container. In this method, the spoon is glued to the lid in a separate production stage by using hot melt glue. The use of hot melt glue requires a separate production since the glue must cool off some before the lid can be applied to the container. When the container is provided with a separate, inner lid, usually a thin foil that conceals the inner of the container in an air tight way, it is also possible to glue the spoon to the inner lid. The glue could however loosen from the foil when the container is opened and could thus fall into the container and contaminate the product in the container.

It would also be possible to attach the additional item to the lid when the lid is produced, and to apply the lid with the additional item in the same stage, when the lid is applied. The stacking of the lids will however be difficult, especially when the additional item is e.g. a scoop that extends out from the underside of the lid.

JP11314618 discloses a device in which an indication description and a spoon are placed on an internal lid of a can. The device comprises a spoon suction part and an indication-description suction part. In this way, the description can be bent by the spoon, and the spoon and the description are integrated and placed on an internal lid, which allows for a more efficient device.

EP0358617 discloses a method and apparatus for applying glue on separate lids and attaching said lids to containers. The lid is collected in a first stage, glue is applied to the edge of the lid by rotating the lid in a second stage and the lid is applied to the container opening in a final mounting stage.

These solutions may work fine in some systems. There is however still room for an improved apparatus and method for applying lids to containers.

SUMMARY OF THE INVENTION

An object of the invention is therefore to provide an improved apparatus for applying lids to containers, where an additional item is attached to the lid before the lid is attached to the container. A further object of the invention is to provide an improved method for applying lids to containers, where additional items are attached to the lids before the lids are attached to the containers.

The solution to the problem according to the invention is described in the characterizing part of claim 1 for the apparatus and in claim 14 for the method. The other claims contain advantageous further developments of the inventive method and apparatus.

In an apparatus for automatic application of lids to containers, comprising a rotatable device unit comprising circumferentially distributed first, second and third lid holding members, a lid feeding unit configured to feed an individual lid to one of the lid holding members, a glue application unit configured to apply glue to an outer edge of a lid held by one of the lid holding members, a lid application unit configured to attach the lid provided with glue to a container, wherein the lid feeding unit, the glue application unit and the lid application unit are distributed circumferentially around the rotatable device unit in correspondence with the circumferential distribution of the first, second and third lid holding members so that the lid holding members can be directed to each of the units simultaneously by rotating the rotatable device unit, the object of the invention is achieved in that the apparatus comprises at least one further circumferentially distributed lid holding member arranged on the rotatable device unit, an item application unit configured to attach an individual additional item onto the lid, wherein the item application unit comprises an item supply unit and at least one transfer device configured to grip an individual additional item from the item supply unit and attach the individual additional item onto the lid, and wherein the apparatus is arranged in such a way that when the first, second and third lid holding members are directed towards the lid feeding unit, the glue application unit and the lid application unit, respectively, the further lid holding member is positioned such as to be in reach of the at least one transfer device.

By this first embodiment of the inventive apparatus, an additional item can be attached to a lid before the lid is attached to the container. One advantage of the apparatus is that the additional item is attached to the lid at the same time as the lid is attached to the container. In this way, there is no need for an additional production stage in which the additional item is attached to the lid before the lid enters the lid attachment stage. This improves the efficiency, reliability and the production rate for applying lids to containers, where the lids comprise individual additional items. Another advantage is that the lids can be stored in a regular way, since there are no additional items attached to the lids during storage of the lids before the lids are attached to the containers. This simplifies the storage of the lids.

In an advantageous development of the inventive apparatus, the at least one transfer device comprises a first and a second movable gripping device, wherein the first movable gripping device is configured to grip the individual additional item from the item supply unit and transfer the individual additional item to the second movable gripping device, wherein the second movable gripping device is configured to grip the individual additional item from the first movable gripping device, transfer the individual additional item to the lid and attach the individual additional item onto the lid. In this way, a reliable and secure attachment of the additional item to the lid is provided.

In an advantageous development of the inventive apparatus, the item application unit is arranged above the rotatable device unit in such a way that the second movable gripping device transfers the individual additional item downwards along a vertical shaft to the lid. This allows for a compact apparatus.

In an advantageous development of the inventive apparatus, the first movable gripping device is configured to transfer the individual additional item in a substantially horizontal manner. This allows for a simplified fitting of the additional item to the lid.

In an advantageous development of the inventive apparatus, the second movable gripping device is configured to grip the individual additional item in a first position facing the first movable gripping device and to rotate to a second position facing the lid. This allows for a reliable attachment of the additional item to the lid.

In an advantageous development of the inventive apparatus, the second movable gripping device comprises a suction device configured to hold the individual additional item. In this way, the additional item is held in a secure way by the gripping device.

In an advantageous development of the inventive apparatus, the second movable gripping device comprises a protrusion member, wherein the protrusion member is adapted to support the individual application item in such a way that the protrusion member pushes the individual item application into receiving means of the lid in a snap-in manner. This allows for a simplified, fast and reliable way of attaching the additional item to the lid, since no glue or adhesive is required.

In an advantageous development of the inventive apparatus, the protruding member is configured to support the individual additional item during transportation from the first movable gripping device to the lid. In this way, a reliable attachment of the additional item to the lid is provided for.

In an advantageous development of the inventive apparatus, the individual additional item is attached onto an underside of the lid, wherein the underside of the lid comprises receiving means in the form of clips configured to receive at least a part of the individual additional item where the individual additional item is attached in its intended position on the underside of the lid. In this way, the additional item can be attached to the lid in a secure way without the use of glue or other adhesives. The individual additional item may be a scoop where the scoop comprises a cup-shaped part and an elongated handle.

In an advantageous development of the inventive apparatus, the moveable gripping device comprises a pair of gripping fingers configured to grip partly around and on opposite sides of a rim of the cup-shaped part of an scoop, wherein each gripping finger has an inner side that comes into contact with the cup-shaped part when gripping the scoop, wherein the inner side has a shape that corresponds to the shape of the rim as well as to a portion of the handle adjacent to the rim so that each gripping finger is allowed to grip the cup-shaped part at least partly around the rim. This allows for a reliable feeding of the scoops to the transfer device.

In an advantageous development of the inventive apparatus, the lid holding members as well as the units are evenly distributed in the circumferential direction in such a way that when the rotatable device rotate one step, the lid holding members are positioned opposite the lid feeding unit, the glue application unit, the lid application unit and the item application unit, respectively.

In an advantageous development of the inventive apparatus, the rotatable device comprises six lid holding members. In this way, it is possible to feed the lids to the lid holding members by the use of gravity, which allows for a simple lid feeding mechanism.

In a method for automatic application of lids to containers, the steps of rotating a rotatable device unit comprising circumferentially distributed first, second, third and at least one further lid holding member, feeding an individual lid to one of the lid holding members by means of a lid feeding unit, attaching an individual additional item onto the lid by means of an item application unit, applying glue to an outer edge of a lid held by one of the lid holding members by means of a glue application unit, and fitting the lid provided with glue to a container by means of a lid application unit are disclosed.

By this first embodiment of the method for applying lids to containers, it is possible to apply an additional item to the lid before the lid is applied to the container. The advantage of this is that the application of an additional item to the lid is simplified. By applying the additional item to the lid at the same time as the lid is applied to the container, a separate stage where the additional item is fitted to the lid is avoided. Further, this allows for a more reliable attachment of items to lids, since the lid with an attached item must not be handled separately, which could lead to an item falling off.

Any of the advantageous features of the present invention above may be combined in any suitable way.

BRIEF DESCRIPTION OF DRAWINGS

The invention will be described in greater detail in the following, with reference to the attached drawings, in which.

DESCRIPTION OF EXAMPLE EMBODIMENTS OF THE INVENTION

The embodiments of the invention with further developments described in the following are to be regarded only as examples and are in no way to limit the scope of the protection provided by the patent claims.

The following examples of the present invention relate, in general, to the field of applying lids to containers and in particularly, to an apparatus and method for an automatic application of an individual additional item to a lid in the same manufacturing process step as when applying the lid to a container.

Examples of the present invention will be described more fully hereinafter with reference to the accompanying drawings, in which examples of the invention are shown. This invention may, however, be embodied in many different forms and should not be construed as limited to the examples set forth herein. Rather, these examples are provided so that this disclosure will be thorough and complete, and will fully convey the scope of the invention to those skilled in the art. Like reference signs refer to like elements throughout.

Figure 1:
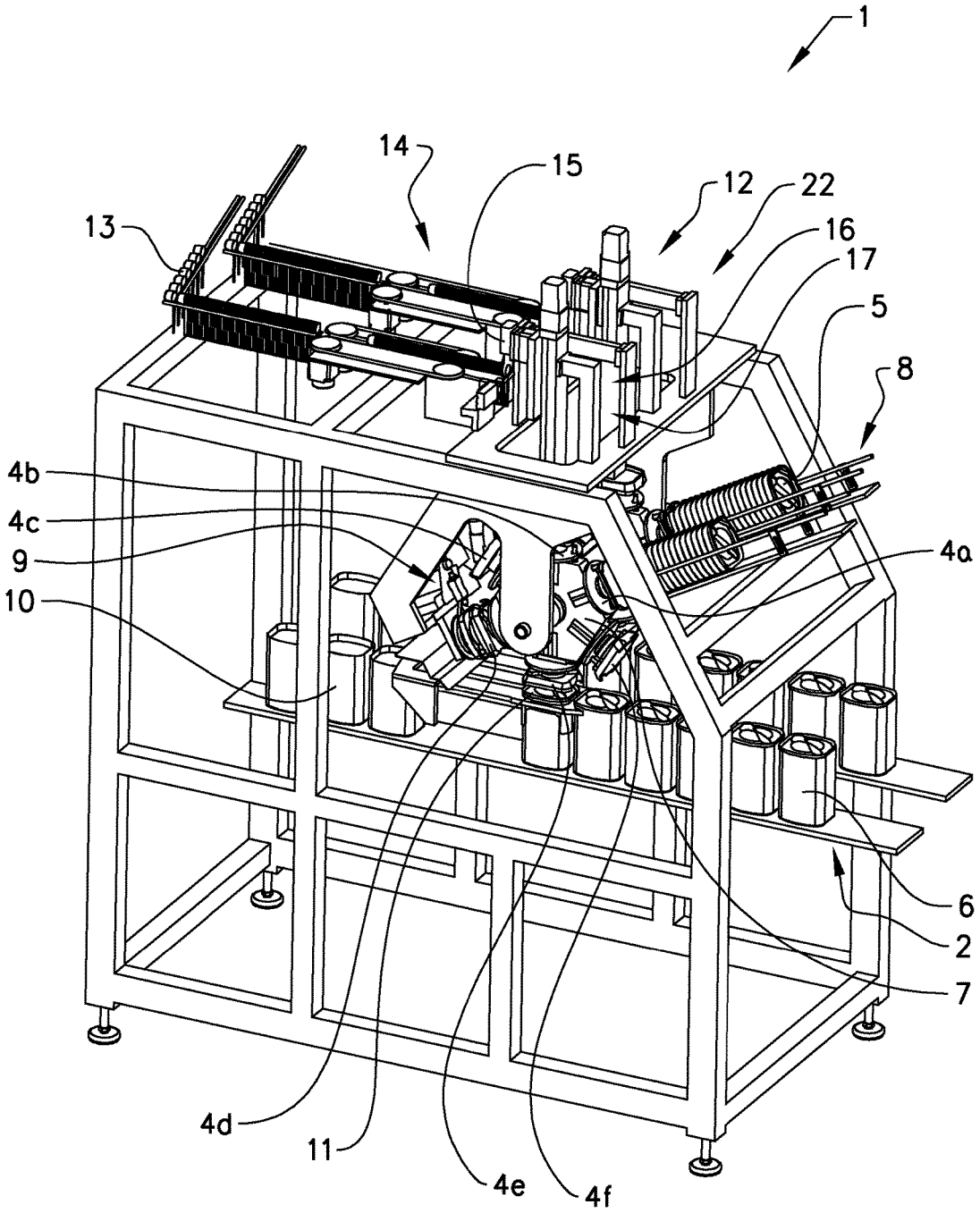
FIG. 1 shows in perspective view an apparatus for automatic application of lids to containers according to the invention.
Figure 2:
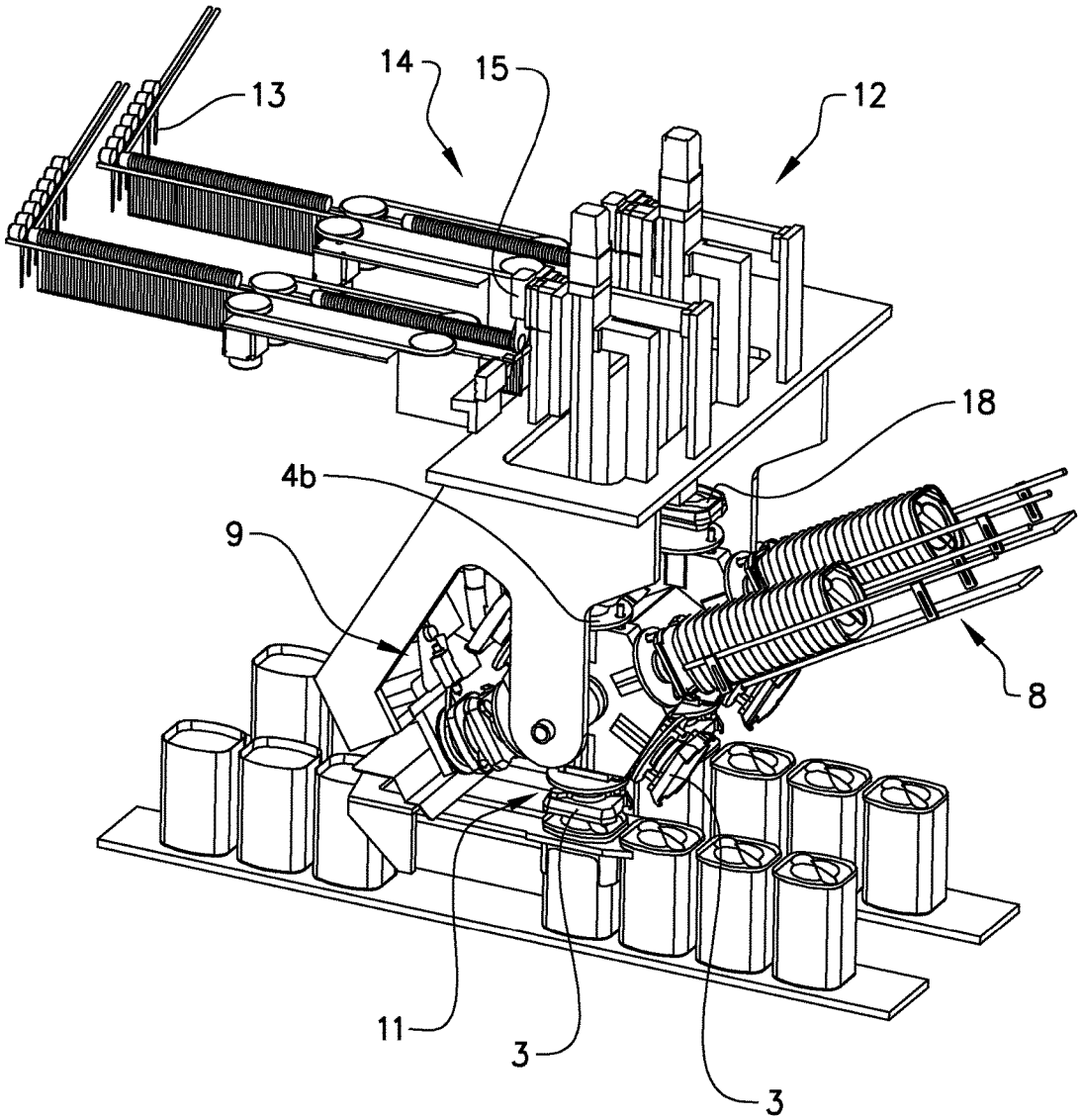
FIG. 2 shows an apparatus for automatic application of lids to containers according to the invention.
Figure 3:
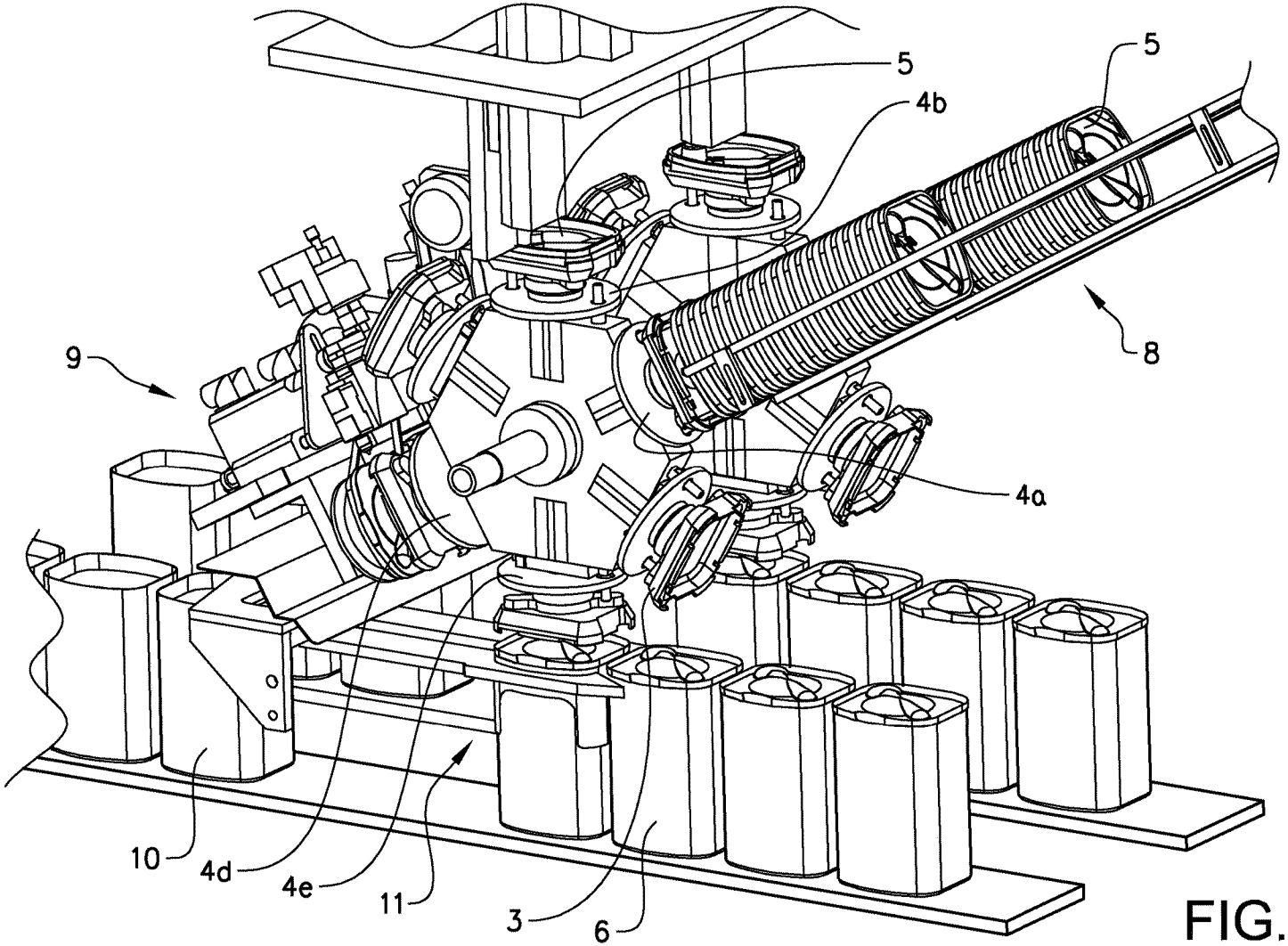
FIG. 3 shows a rotating device of an apparatus for automatic application of lids to containers according to the invention.
Figure 4A:
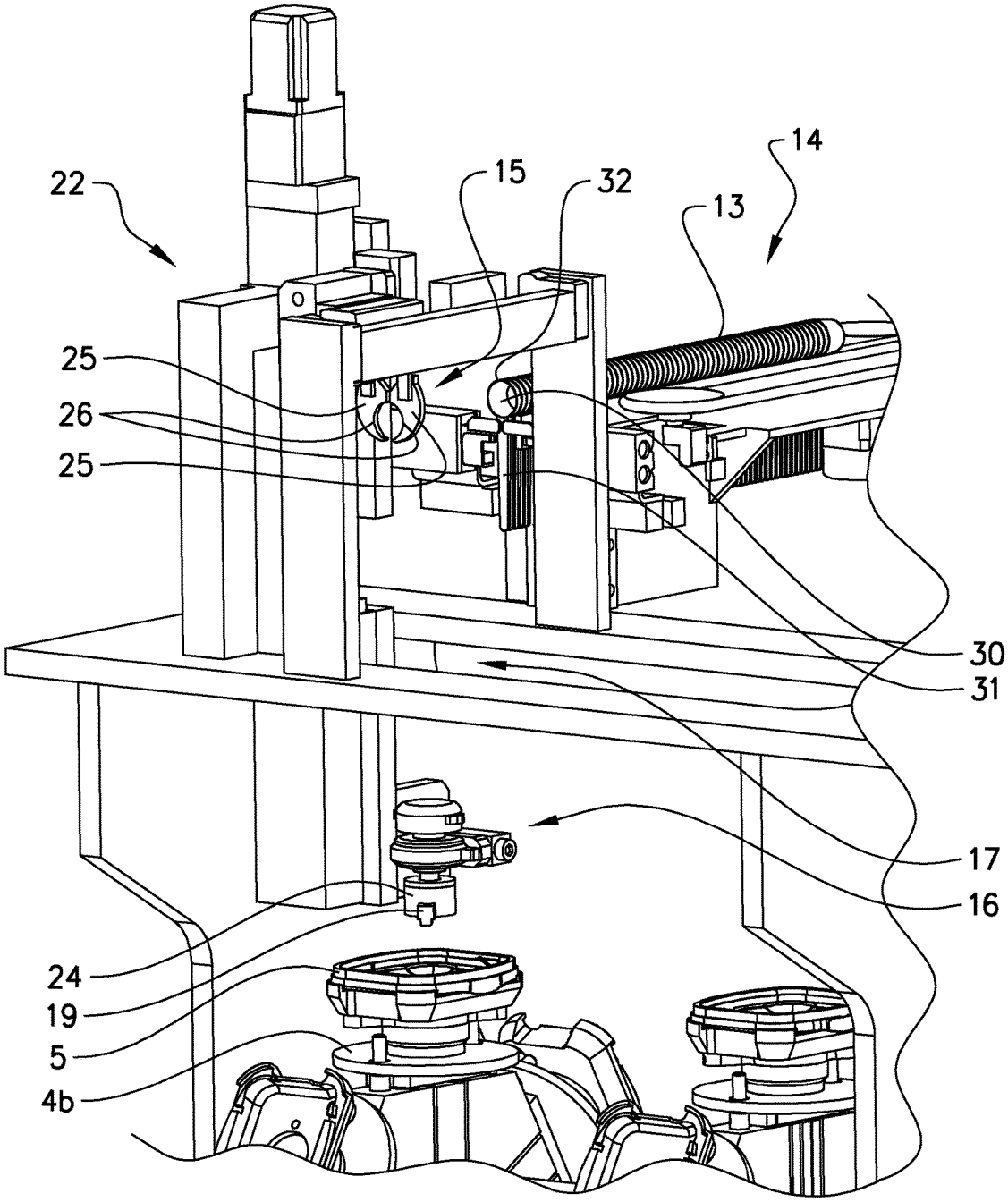
FIG. 4*a*-4*f* shows the pick-up and insertion of an additional item in an apparatus for automatic application of lids to containers according to the invention.
Figure 4B:
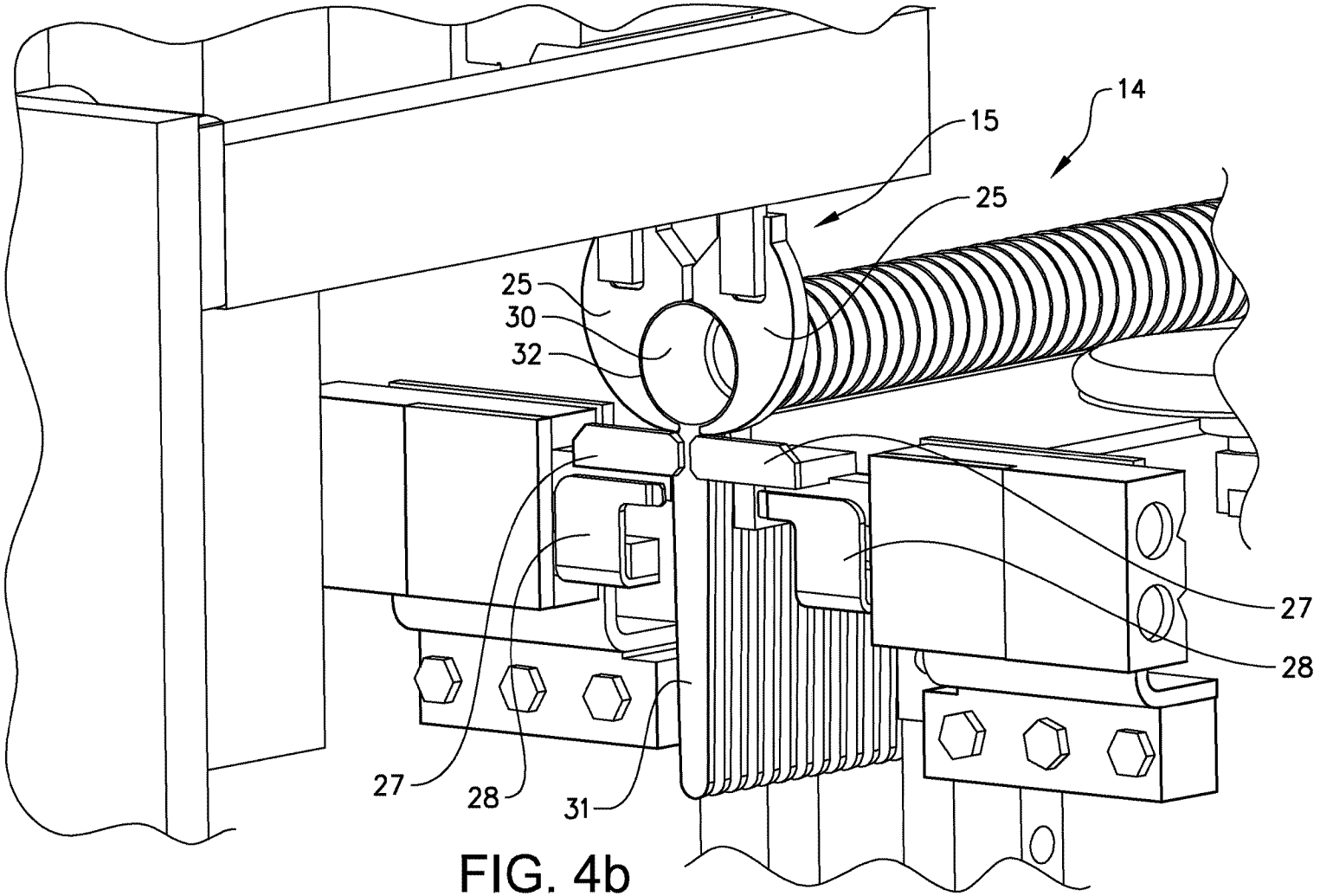
Figure 4C:
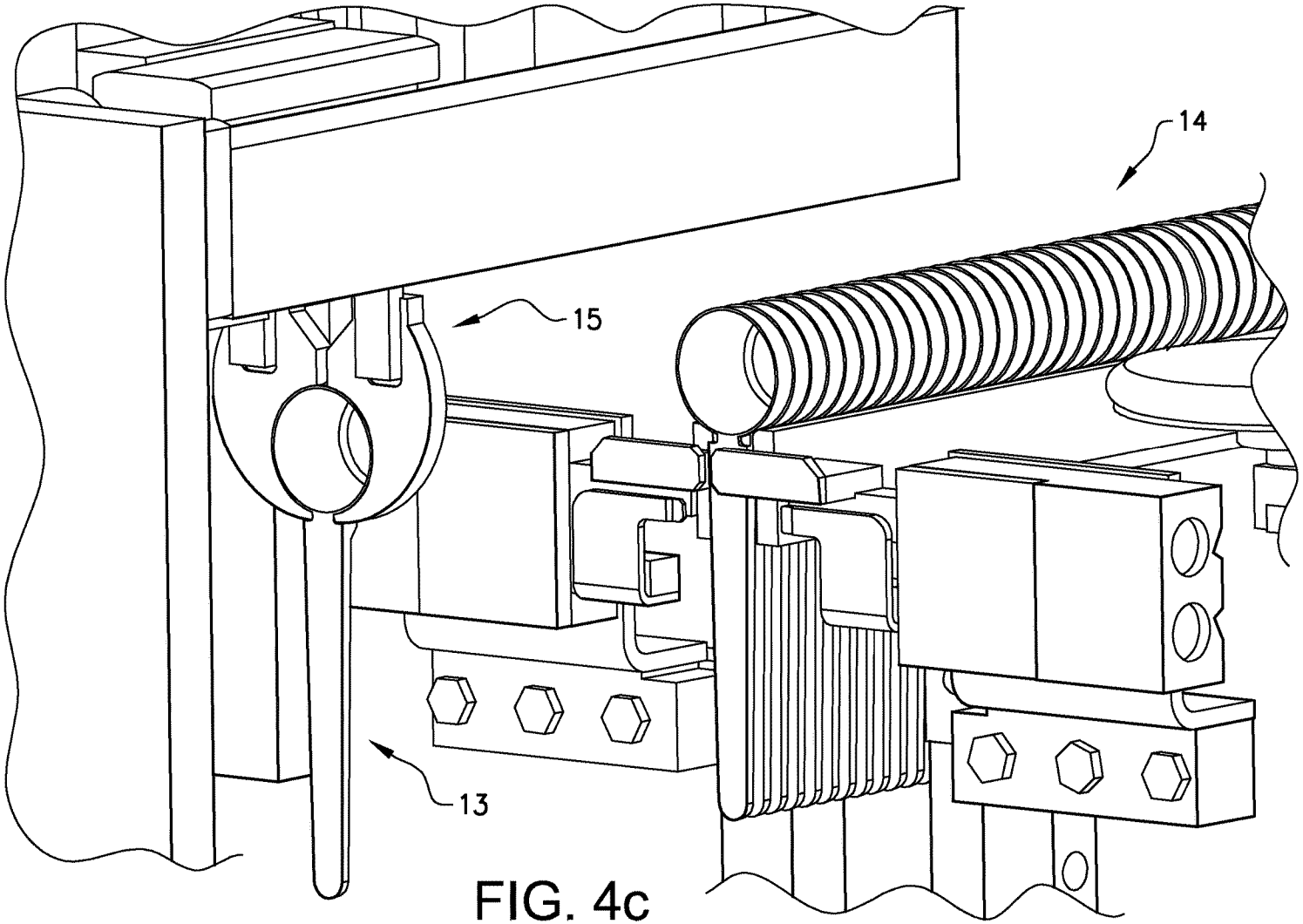
Figure 4D:
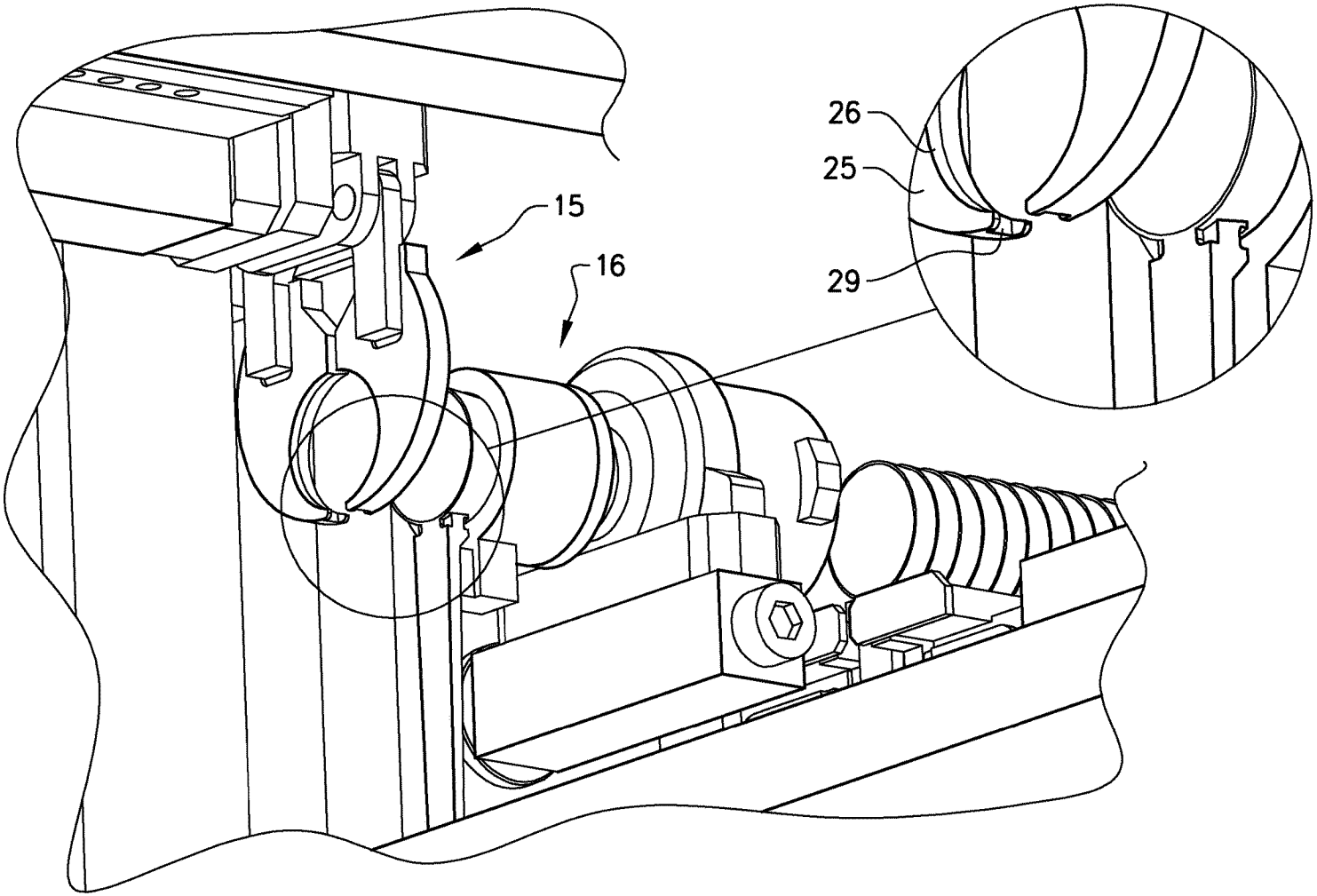
Figure 4E:
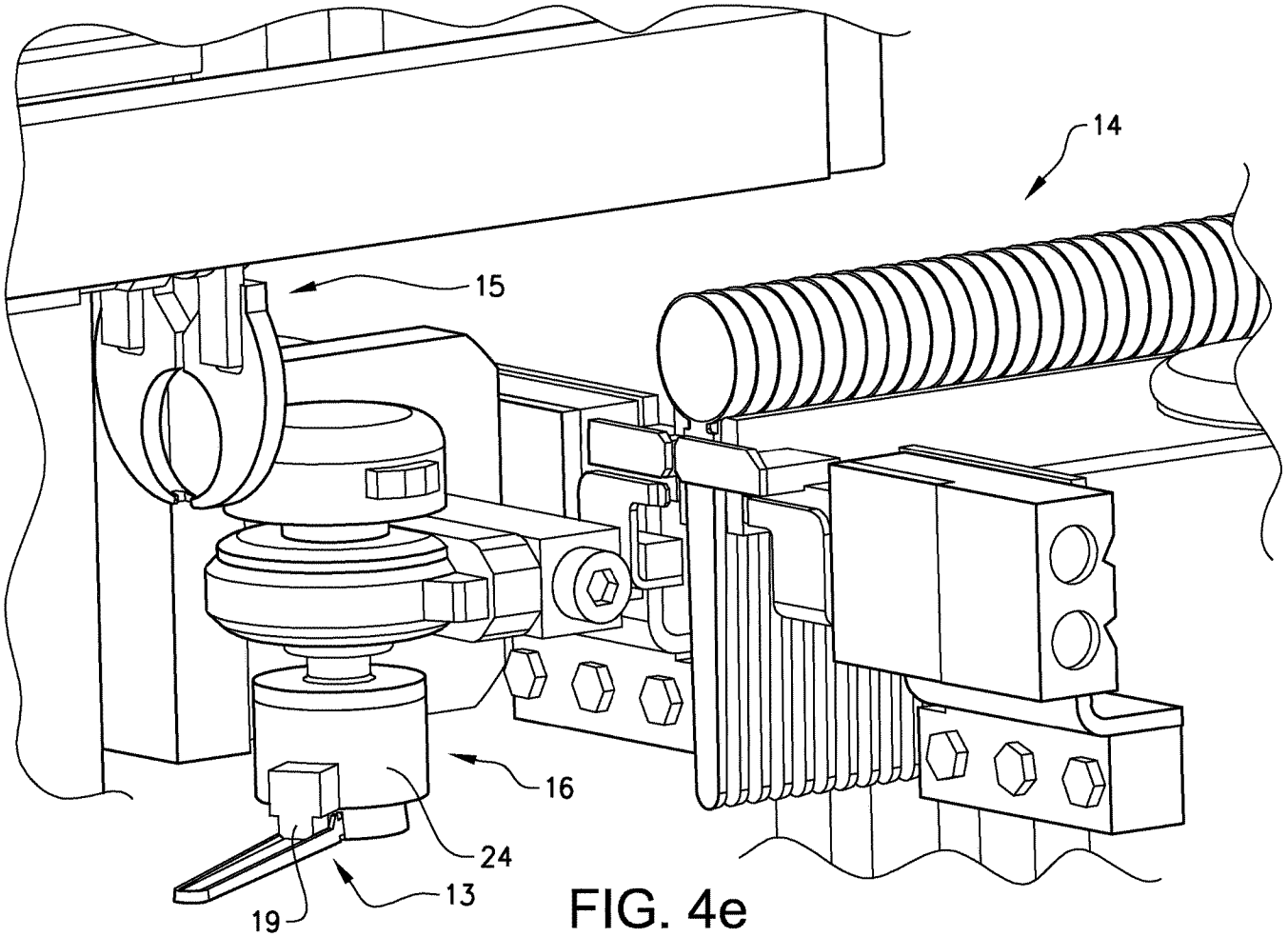
Figure 4F:
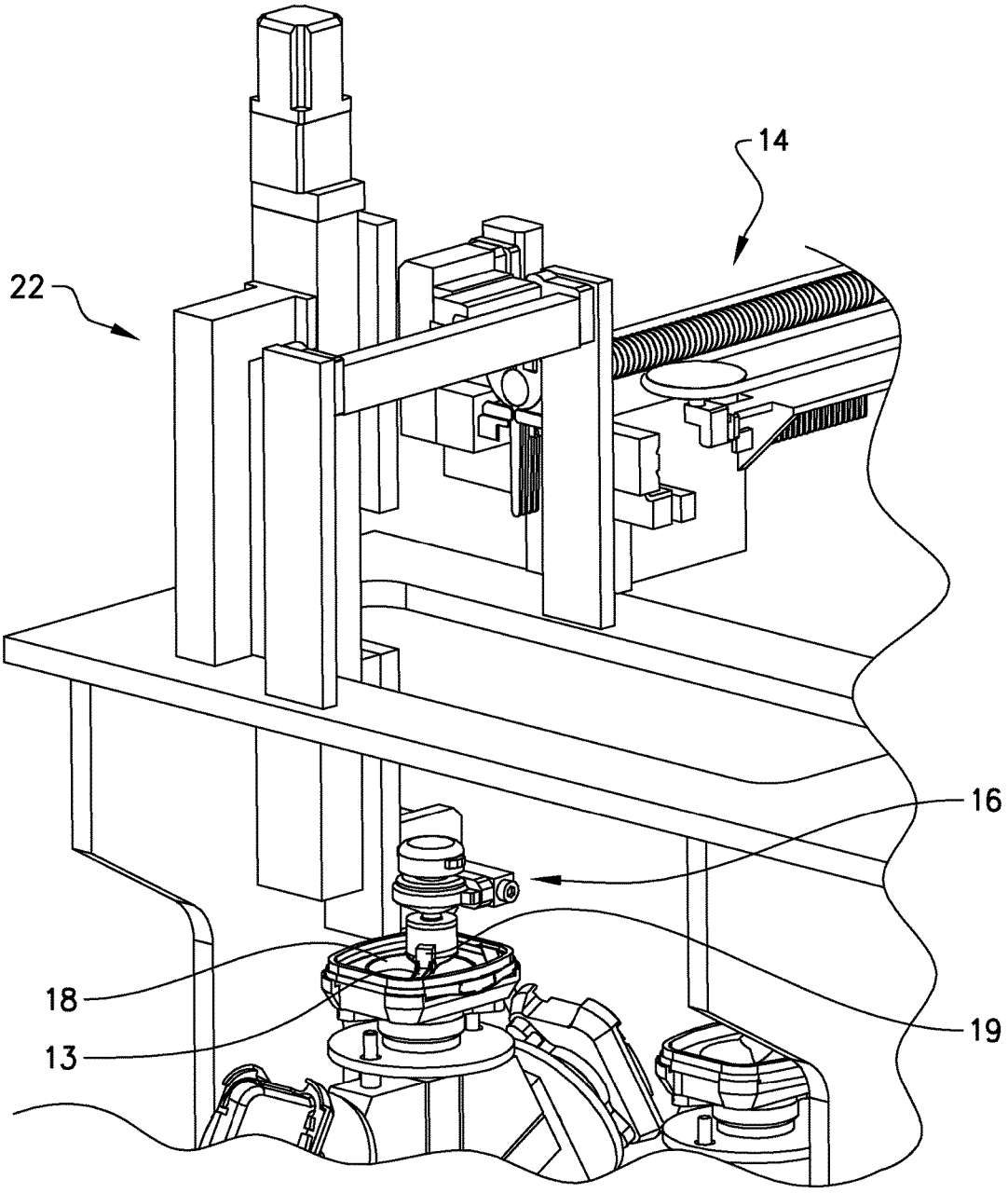
Figure 5:
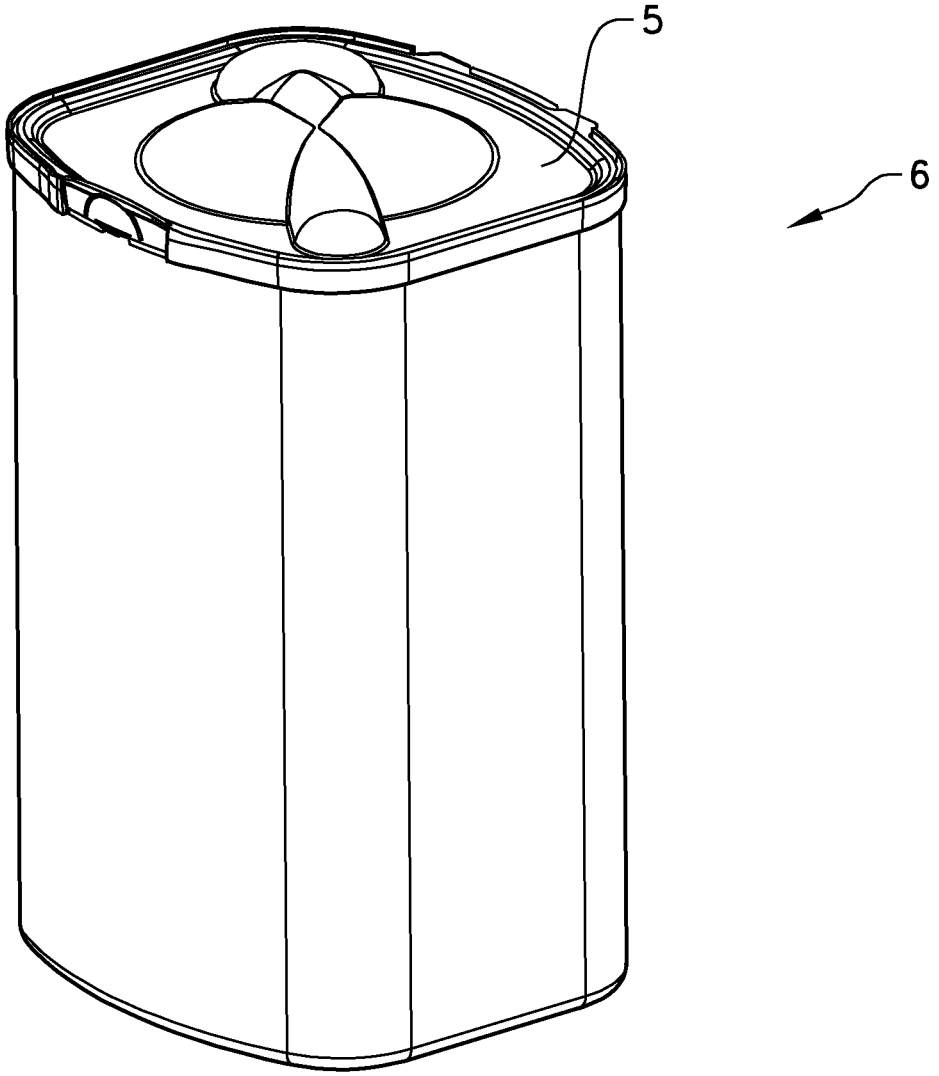
FIG. 5 shows a container comprising a closed lid according to the invention.
Figure 6:
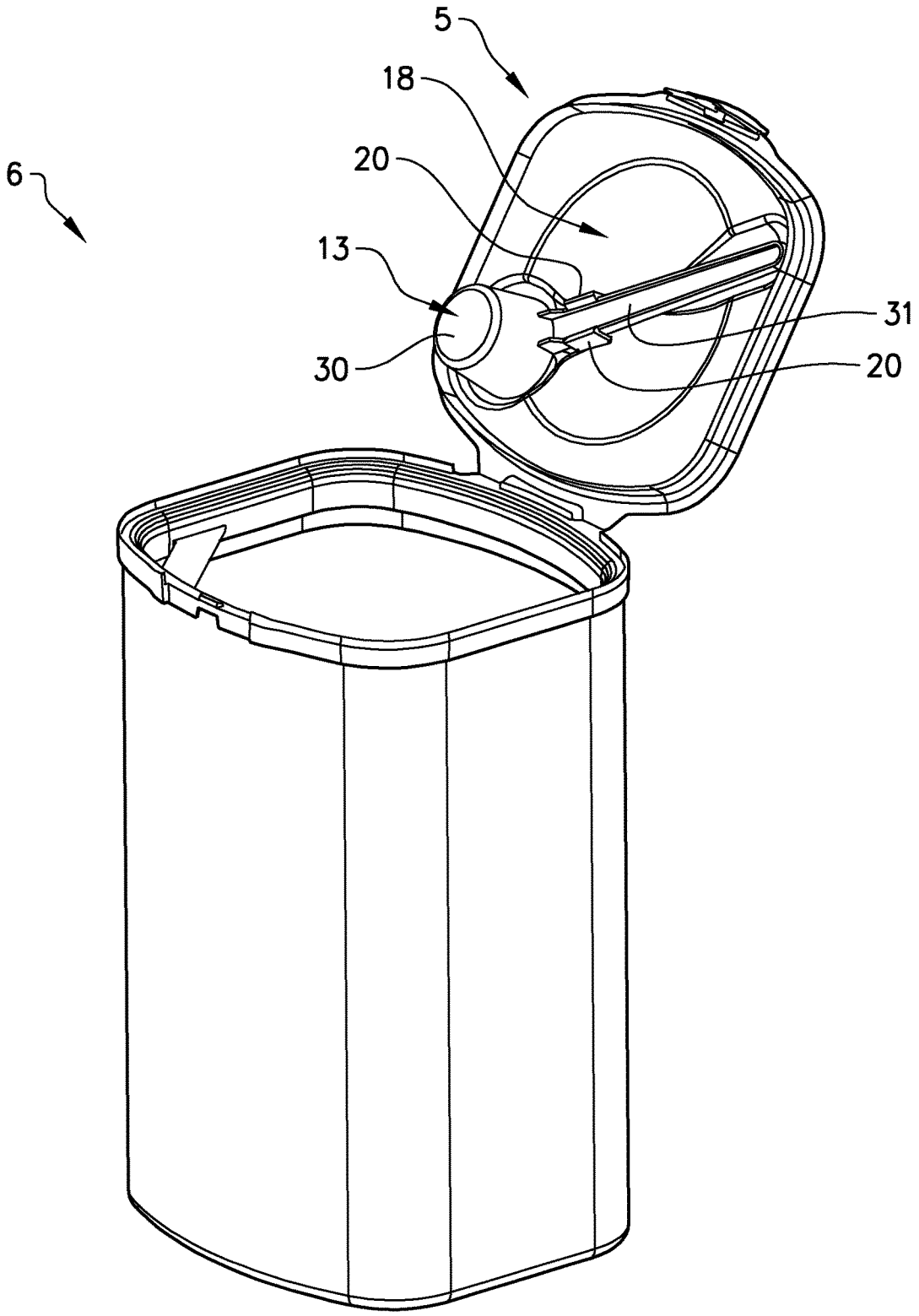
FIG. 6 shows a container comprising an opened lid according to the invention.

FIGS. 1 to 5 show an inventive apparatus for the automatic application of lids to containers, where an additional item is attached to the lid prior to attaching the lid to the container. FIGS. 6 and 7 show a container with an attached lid suitable for the apparatus. The apparatus 1 comprises a rotatable device unit 7 arranged in an open frame of the apparatus. A conveyor 2 runs through the frame, transporting containers 10 without a lid to the rotatable device unit 7 and transporting containers with an attached lid 5 from the rotatable device unit 7. The apparatus further comprises a lid feeding unit 8 configured to feed lids 5 to a lid holding member of the rotatable device unit 7. The lid feeding unit is arranged with an inclination angle to the horizontal plane, in the shown example having 6 lid holding members, the inclination angle is 30 degrees. In this way, the lids will be fed forward with gravitation force such that no springs or other feeding aids are required. This simplifies the lid feeding unit and allows lids to be inserted into the lid feeding unit without interruption in the feeding, which would be the case with a horizontal feeding unit where springs or the like feeds the lids forward.

The apparatus further comprises an item application unit 12 comprising an item supply unit 14 and a transfer device 22 adapted to feed individual items 13 to the rotatable device unit 7 from above. The additional items arrive at the apparatus in a plane above the rotatable device unit and are transported down to the rotatable device unit in a vertical direction by the transfer device 22. In the shown example, a scoop for a powdery product is used as an example of an additional item. Other types of additional items, such as spoons, instruction leaflets, toys or the like, can of course also be fed to the rotatable device unit 7 by adapting the item application unit to the specific item. In the shown example, two separate lid application production lines are shown arranged in parallel.

The rotatable device unit 7 comprises in the shown example six lid holding members 3 adapted to hold a lid in different positions 4 in the rotatable device unit. The lid holding members are circumferentially distributed in a symmetric way. In the shown example, the spacing of the lid holding members is 60 degrees. Other numbers of lid holding members are possible.

Since four different operations are performed in the apparatus, a minimum of four lid holding members are required. Since the units around the rotatable device unit should be positioned such that each unit is positioned at a lid holding member when the rotatable device unit stops, four lid holding members would require a horizontal lid feeding unit. Since the lid is attached to the container at the lowermost position and the additional item is attached to the lid from above, at the highest position, an even number of lid holding members is of advantage.

The lid holding members 3 of the rotatable device unit 7 can be stopped in six different positions, 4*a*-4*f*. In a first position 4*a*, a lid holding member 3 is positioned at the lid feeding unit 8. In this position, a lid 5 is fed to the lid holding member by a known lid feeding mechanism and is held by the lid holding member, comprising e.g. a vacuum cup or holding clips. In a second position 4*b*, an additional item 13 is attached to the lid by the second, lower movable gripping device 16 of the transfer device. The third position 4*c* is an idle position. In the fourth position 4*d*, glue is applied to the outer edge 21 of the lid by a known glue application unit 9. The glue application unit 9 rotates the lid such that the glue dispensed from the glue applicator is applied on the edge. In position 4*e*, the lid is attached to a container 10 by the lid application unit 11. The lid with the glue is pushed down onto the container such that the lid is fixedly attached to the container. Position 4*f* is also an idle position.

The additional items 13 are in this example forwarded to the transfer device 22 by the item supply unit 14. The additional item is in the example a scoop and is forwarded by guiding rails and a feeding device. The scoop is forwarded to a delivery position, where a hold and release mechanism comprising two sets of reciprocating holding fingers, an upper set of holding fingers 27 and a lower set of holding fingers 28, ensures that only one scoop at a time is release. When a scoop is in the delivery position, it bears on the upper set of holding fingers 27. In this way, the delivery position ensures that the scoop is in a well defined delivery position. FIG. 4*a* shows the start position for the transfer of a scoop from the item supply unit to the lid. In this position, the upper gripping device 15 is in its end position, where it will release a scoop to the lower gripping device, and the lower gripping device 16 is in an idle position.

In FIG. 4*b*, the upper gripping device 15 is in a pick-up position, where the gripping device 15 grips a scoop 13 by the rim 32. The scoop comprises a cup-shaped part 30 with the rim 32 and an elongated handle 31. The gripping device comprises two gripping fingers 25 which are provided with a shape that corresponds to the shape of the item that is to be gripped. In this example, the gripping fingers are shaped such that each gripping finger is provided with a semi-circular shape, such that the inner sides 26 of the gripping fingers bears on the rim of the scoop when the gripping fingers grip the scoop. The hold and release mechanism releases the scoop and the gripping device 15 moves to the end position, where it holds the scoop, as is shown in FIG. 4*c*. Each gripping finger 25 is further provided with a cut out 29 at the lower side of each finger. On each side of the cut out, a small flange extends. The cut out is adapted to the shape of the handle of the scoop in the region closest to the cup-shaped part, such that the gripping fingers 25 will also grip the scoop at the handle. In this way, the gripping fingers will hold the scoop in a secure way with the flanges supporting the handle at the front and rear side. In this way, the scoop cannot fall out of the gripping device since the scoop is supported forwards and backwards in the horizontal direction.

When the scoop is held in the end position by the upper gripping device, the lower gripping device moves upwards along the vertical shaft 17 to a position next to the upper gripping device and thus next to the scoop, where it will pick up the scoop from the upper gripping device, as shown in FIG. 4*d*. The scoop is at the same time released from the upper gripping device by opening the gripping fingers. The lower gripping device is provided with a suction device 24 which holds the scoop. A protrusion member 19 will at the same time bear against the handle of the scoop. The scoop is provided with one or more small holes that will allow even packed powder to release from the scoop, such that an under pressure is avoided in the scoop when a powdery product is to be released. The suction pressure of the suction device is preferably adapted to the area of the release holes and the weight of the scoop.

When the scoop is picked up by the lower gripping device, the device tilts the scoop by 90 degrees such that the opening of the scoop is directed downwards. At the same time, the lower gripping device may rotate the scoop such that the position corresponds to the mounting position in the lid, as is shown in FIG. 4*e*. When the scoop is in the proper position, the lower gripping device will move downwards along the vertical shaft towards the lid which is in position 4*b*. The lower gripping device pushes the scoop into the catching clips 20 of the lid. The protrusion member 19 supports the handle of the scoop such that the handle is securely inserted between the clips. The suction pressure is released and the lower gripping device returns to the idle position or moves upwards directly to pick up the next scoop. The insertion of a scoop to a lid is shown in FIG. 4*f*.

When the scoop is positioned in the lid, the rotatable device unit forwards the lid to the glue application unit and further to the lid application, where the lid is attached to the container as described above. FIG. 5 shows a container with an attached lid in a closed state, and FIG. 6 shows a container where the lid is opened, and where a scoop is held at the underside 18 of the lid.

The invention is not to be regarded as being limited to the embodiments described above, a number of additional variants and modifications being possible within the scope of the subsequent patent claims.

REFERENCE SIGNS

1: Apparatus for automatic application of lids to containers
2: Conveyor
3: Holding member
4*a*-4*f*: Operating positions of the holding members
5: Lid
6: Container with lid
7: Rotatable device unit
8: Lid feeding unit
9: Glue application unit
10: Container
11: Lid application unit
12: Item application unit
13: Individual additional item
14: Item supply unit
15: First movable gripping device
16: Second movable gripping device
17: Vertical shaft
18: Underside of lid
19: Protrusion member
20: Clip
21: Outer edge of lid
22: Transfer device
24: Suction device
25: Gripping finger
26: Inner side
27: Upper reciprocating gripping fingers
28: Lower reciprocating gripping fingers
29: Cut out
30: Cup-shaped part
31: Elongated handle
32: Rim

The invention claimed is:

1. An apparatus for automatic application of lids to containers, said apparatus comprising a rotatable device unit comprising a plurality of circumferentially distributed lid holding members;

a lid feeding unit configured to feed an individual lid to one of the lid holding members;

a glue application unit configured to apply glue to an outer edge of a lid held by one of the lid holding members;

a lid application unit configured to attach the lid provided with glue to a container;

wherein the lid feeding unit, the glue application unit and the lid application unit are distributed circumferentially around the rotatable device unit in operating positions in correspondence with the circumferential distribution of the lid holding members such that the lid holding members can be directed to each of the units simultaneously by rotating the rotatable device unit, wherein the apparatus further comprises an item application unit configured to fit an individual additional item onto the lid, wherein the item application unit comprises an item supply unit and at least one transfer device configured to grip an individual additional item from the item supply unit and attach the individual additional item to the lid, and wherein the apparatus is arranged in such a way that when the lid holding members are directed towards the lid feeding unit, the glue application unit and the lid application unit, respectively, the further lid holding member is positioned such as to be in reach of the at least one transfer device.

2. The apparatus according to claim 1 wherein the at least one transfer device comprises a first and a second movable gripping device, wherein the first movable gripping device is configured to grip the individual additional item from the item supply unit and transfer the individual additional item to the second movable gripping device, wherein the second movable gripping device is configured to grip the individual additional item from the first movable gripping device, transfer the individual additional item to the lid and attach the individual additional item onto the lid.

3. The apparatus according to claim 2, wherein the item application unit is arranged above the rotatable device unit in such a way that the second movable gripping device transfers the individual additional item downwards along a vertical shaft to the lid.

4. The apparatus according to claim 2, wherein the first movable gripping device is configured to transfer the individual additional item in a substantially horizontal manner.

5. The apparatus according to claim 2, wherein the second movable gripping device is configured to grip the individual additional item in a first position facing the first movable gripping device and to rotate to a second position facing the lid.

6. The apparatus according to claim 2, wherein the second movable gripping device comprises a suction device configured to hold the individual additional item.

7. The apparatus according to claim 2, wherein the second movable gripping device comprises a protrusion member, wherein the protrusion member is adapted to support the individual additional item in such a way that the protrusion member pushes the individual additional item application into receiving means of the lid in a snap-in manner.

8. The apparatus according to claim 7, wherein the protrusion member is configured to support the individual additional item during transportation from the first movable gripping device to the lid.

9. The apparatus according to above claim 1, wherein the individual additional item is attached onto an underside of the lid, wherein the underside of the lid comprises receiving means in the form of clips configured to receive at least a part of the individual additional item where the individual additional item is attached in its intended position on the underside of the lid.

10. The apparatus according to claim 1, wherein the individual additional item is a scoop, where the scoop comprises a cup-shaped part and an elongated handle.

11. The apparatus according to claim 10, wherein the moveable gripping device comprises a pair of gripping fingers configured to grip partly around and on opposite sides of a rim of the cup-shaped part of an individual scoop, wherein each reciprocating gripping finger has an inner side that bears on the cup-shaped part when gripping the scoop, wherein the inner side has a shape that corresponds to the shape of the rim as well as to a portion of the handle adjacent to the rim so that each gripping finger is allowed to grip the cup-shaped part at least partly around the rim.

12. The apparatus according to claim 1, wherein the lid holding members as well as the units are evenly distributed in the circumferential direction in such a way that when the rotatable device rotate one step, the lid holding members are positioned opposite the lid feeding unit, the glue application unit, the lid application unit and the item application unit, respectively.

13. The apparatus according to claim 1, wherein the rotatable device comprises six lid holding members.

14. A method for automatic application of lids to containers using the apparatus according to claim 1, comprising:

rotating the rotatable device;

feeding an individual lid to one of the lid holding members, by means of the lid feeding unit;

attaching an individual additional item onto the lid, by means of the item application unit, applying glue to an outer edge of the lid held by one of the lid holding members, by means of the glue application unit;

attaching the lid provided with glue to a container, by means of the lid application unit.

15. The method according to claim 14, wherein at least of one of the lid holding members is positioned such as to be in reach of at least two movable gripping devices.

16. The apparatus according to claim 3, wherein the first movable gripping device is configured to transfer the individual additional item in a substantially horizontal manner.

17. The apparatus according to claim 3, wherein the second movable gripping device is configured to grip the individual additional item in a first position facing the first movable gripping device and to rotate to a second position facing the lid.

18. The apparatus according to claim 3, wherein the second movable gripping device comprises a suction device configured to hold the individual additional item.

19. The apparatus according to claim 3, wherein the second movable gripping device comprises a protrusion member, wherein the protrusion member is adapted to support the individual additional item in such a way that the protrusion member pushes the individual additional item application into receiving means of the lid in a snap-in manner.

20. The apparatus according to above claim 3, wherein the individual additional item is attached onto an underside of the lid, wherein the underside of the lid comprises receiving means in the form of clips configured to receive at least a part of the individual additional item where the individual additional item is attached in its intended position on the underside of the lid.

* * * * *